United States Patent [19]

Kester, Jr.

[11] Patent Number: 4,520,709

[45] Date of Patent: Jun. 4, 1985

[54] RIMLESS DRUM STRUCTURE WITH TUNING DEVICE

[76] Inventor: Ralph C. Kester, Jr., 1531-20th Ave. North, Lake Worth, Fla. 33460

[21] Appl. No.: 21,718

[22] Filed: Mar. 19, 1979

[51] Int. Cl.[3] ..... G10D 13/02

[52] U.S. Cl. ..... 84/415; 84/411 R; 84/411 M

[58] Field of Search ..... 84/411–421; D17/22

[56] References Cited

U.S. PATENT DOCUMENTS

| | | | |
|---|---|---|---|
| 342,062 | 5/1886 | Bemis | 84/421 |
| 578,198 | 3/1897 | Boulanger | 84/411 R |
| 834,865 | 10/1906 | Berlinghoff | 84/412 |
| 1,579,893 | 4/1926 | Simpson | 84/411 M |
| 2,295,479 | 9/1942 | Jeffries | 84/415 |
| 2,934,989 | 5/1960 | Belli et al. | 84/414 |
| 3,186,289 | 6/1965 | Kester | 84/415 X |
| 3,482,479 | 12/1969 | Della-Porta | 84/411 R |
| 3,626,801 | 12/1971 | Moore | 84/411 R |
| 3,635,119 | 1/1972 | Thompson | 84/411 R |
| 3,647,931 | 3/1972 | Koishikawa | 84/414 X |
| 3,865,003 | 2/1975 | Della-Porta | 84/411 R |
| 3,951,032 | 4/1976 | La Porta et al. | 84/419 |

FOREIGN PATENT DOCUMENTS

| | | | |
|---|---|---|---|
| 2248 | of 1859 | United Kingdom | 84/411 R |
| 1657 | of 1862 | United Kingdom | 84/411 R |

*Primary Examiner*—Lawrence R. Franklin

*Attorney, Agent, or Firm*—Marmaduke A. Hobbs

[57] ABSTRACT

A rimless drum structure in which a drumhead has a membrane attached to an outer ring and an adjustment ring is disposed beneath the membrane within the outer ring. Tuning devices are spaced around the rings and are adjustable to urge the inner ring against the underside of the membrane and thereby varying the tension and the tuning of the membrane. Two of such drumheads may be assembled in opposing fashion through the use of a plurality of rigid spacer members attached between the brackets of the upper and lower drumheads. An adjustable snare device having a cam type quick release mechanism and a snare tension adjustment device, may be mounted on the dual headed assembly. Sound control devices having bumpers exerting an adjustable amount of force on the upper drumhead membrane may also be used and these devices may be moved to positions at variable distances from the center of the drumhead to vary the sound effect.

18 Claims, 8 Drawing Figures

Fig. 3
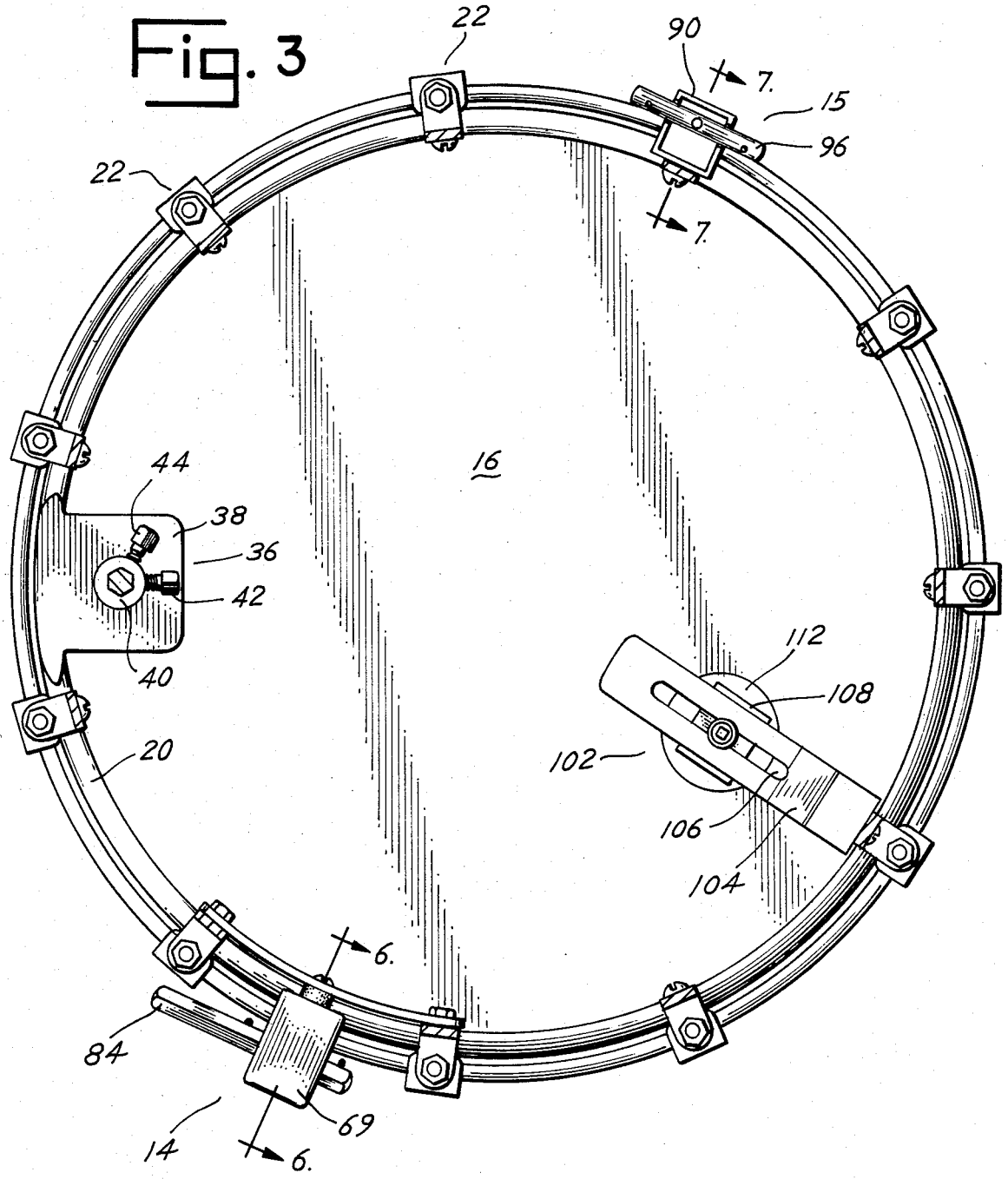
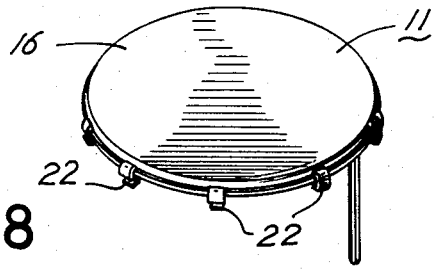
Fig. 8

RIMLESS DRUM STRUCTURE WITH TUNING DEVICE

In the conventional design for a drum, the drumhead is stretched tautly across a cylindrical shell and is attached to a tuning ring which surrounds the outside of the shell. The tuning ring has an adjustable means for increasing or decreasing the tension of the drumhead across the top of the cylindrical shell, thereby tuning the drum. This design is inherently large and cumbersome, and due to the sheer weight and awkwardness of such an instrument, drummers in marching bands are severely restricted in the performance of intricate marching and drill maneuvers. Often the entire band formation has to be planned around a semi-immovable drum section. Lengthy marching performances are very taxing, physically, upon drummers who must carry these heavy instruments, especially the bass drum. Additionally, the cylindrical shell acts somewhat as a directional device diverting the sound tones down toward the ground and partially muffling the sound. The present day desire to electronically amplify drum sounds is difficult to achieve with the shell type drums, in that a microphone must be placed against or attached to the shell or drumhead to effectively receive the drum sounds. Storage and transportation of shell drums is also difficult since space requirements are excessive.

Subsequent modifications in drum designs, such as that disclosed in my patent for a drum, U.S. Pat. No. 3,186,289, issued June 1, 1965, have been only partially successful in remedying the inherent problems of the conventional drum design. While my aforementioned prior patent eliminated the large bulky and heavy shell type structures used in conventional drums, the drumhead was still suspended within a relatively wide outer rim in a somewhat complex fashion which, although lighter than a conventional drum, was still substantially heavier than the drumhead alone. Also, though greatly improving over conventional designs, the improved drum design continued, to some extent, to direct the sound emanating from the drumhead. The drumhead tensioning devices were positioned within the confines of the rim which restricted access thereto. It is therefore one of the principal objects of the present invention to provide a drumhead tuning device which fits directly on the drumhead and does not require a rim or other device in which to suspend the drumhead, and which is readily accessible for the tuning of the drum so as both to make tuning easier and to encourage drummers to maintain proper tune of the instrument, and yet still permitting two of such drumheads to be easily assembled in opposition to each other, while maintaining ready accessibility to the tuning device in the dual assembly.

Another object of the present invention is to provide a simplified construction and design for drums which reduces the size and weight of the drum structure, thereby enhancing the maneuverability of a marching drummer doing complicated marching maneuvers and reducing the physical effort required to carry such a drum while at the same time presenting a pleasing appearing drum structure, and which need not be round but may also be constructed in other shapes such as square, oblong, triangular or the like.

Still another object of the present invention is to provide a drumhead tuning device and rimless drum structure which can be adapted for use on all sizes of drums from the very small to the very large, and which has a releasable snare attachment mechanism and readily accessible snare adjusters which can easily and quickly be adjusted or eliminated, thereby creating lightweight and easily carried groupings of drums having similar appearances but which may have differentiated note ranges and sound tones.

A further object of the present invention is to provide a construction and design for drums in which omnidirectional sound projection is achieved, and which provides a more uniform sound projection of increased tonal quality with little or no muffling effect, yet provides increased sound volume from the beating of a single drumhead.

A still further object of the present invention is to provide a construction and design for drums in which reduced size and weight of the drum reduce storage space requirements on a day-to-day basis and in travel, and which permit easy assembly and disassembly of the drumheads in opposing fashion so as to facilitate storage and transport of dual headed drums as well.

Yet another object of the present invention is to provide a construction and design for drums which permit carrying the drum in an elevated position away from the marching drummer, thus allowing more freedom of movement for high-step or fast cadence march maneuvers, and which may readily be attached to various other carrying devices such as spinner rigs to provide unique visual effects, but which also may easily be attached to stands or other supportive devices for stationary use in concert band situations and, because of the rimless design, make electronic miking for amplification simple and easy.

Further objects and advantages of the present invention will be clear from the following detailed descriptions and diagrams wherein:

FIG. 3 is a horizontal cross sectional view of the aforementioned snare drum, the cross section being taken on line 3—3 of FIG. 2;

FIG. 8 is a perspective view of a single head drum.

Figure 1:
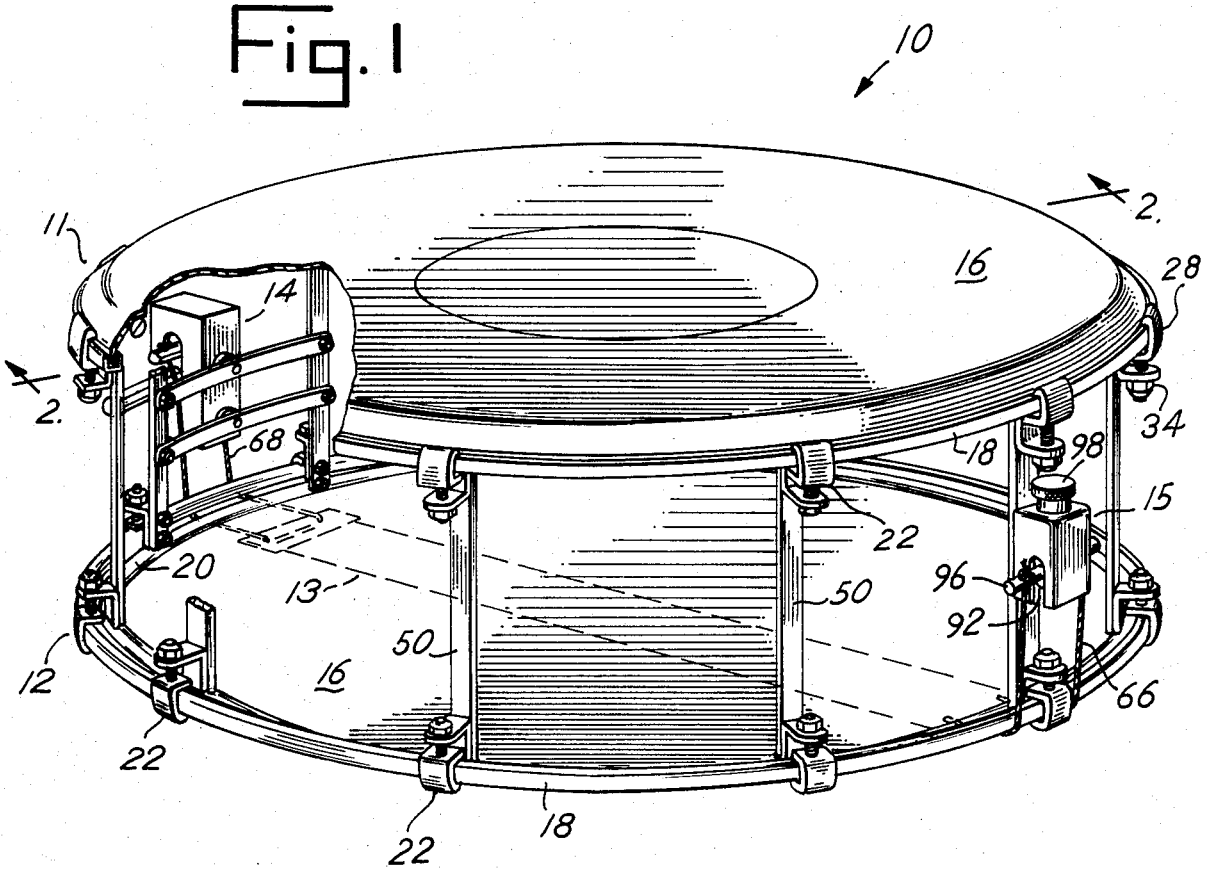
FIG. 1 is a perspective view of a snare drum embodying the present invention having a partial cut-out to better reveal the structure.

Referring more specifically to the drawings, and FIG. 1 in particular, numeral 10 indicates a snare drum embodying the present invention, and having an upper drumhead 11 and a lower drumhead 12. A snare device 13, having a release mechanism 14 and a snare tension adjuster 15, is positioned below drumhead 12. Each of drumheads 11 and 12 is similar in construction, and therefore like numerals shall represent similar parts on each drumhead.

Each of the drumheads 11 and 12 consists of a drumhead membrane 16 made of any conventional drumhead material such as plastic, calfskin or the like, which is securely attached around its periphery to a rigid outer ring or mounting hoop 18. The tuning device of the present invention mounts directly on outer ring 18 and thereby enables the drumhead to be used without any other support or suspension mechanism. Outer ring 18 need not be very wide, but must be of sufficient rigidity to act as an anchor for the drumhead and as a support for the tuning device. The tension of the drumhead membrane and the force exerted by the tuning device will both be transmitted to outer ring 18. The tuning device consists of a tensioning ring 20 having a slightly smaller external diameter than the internal diameter of outer ring 18. Tensioning ring 20 is positioned within the outer ring 18 and is connected to the outer ring by a plurality of attachment and adjustment devices 22 spaced around the perimeter of the drum structure.

Each attachment and adjustment device consists of an L-shaped bracket 24 integrally attached to tensioning ring 20 and extending away from the drumhead with the L-shape forming portions perpendicular to and parallel with the drumheads with the parallel portion having a hole 26. A second bracket piece 28 having notched portion 30 engages the outer edge of ring 18 at the notched portion and extends away from the drumhead, also forming a general "L" shape with portions parallel and perpendicular to the drumhead. The portion of bracket 28 parallel with the drumhead is positioned between outer ring 18 and the parallel portion of bracket 24. An externally threaded member 32 integrally attached to bracket 28 at the portion of bracket 28 parallel with the drumhead extends generally away from the drumhead and through hole 26 of bracket 24. Hole 26 is not threaded and therefore does not engage the threads of member 32, but permits member 32 to slide freely through it. A nut 34, preferably of the self locking variety, is attached to threaded member 32 and serves as an abutment for bracket 24, which in turn braces tensioning ring 20. Thus, as nut 34 is turned farther onto threaded member 32, the parallel portion of bracket 24 is moved closer to outer ring 18 and tuning ring 20 is forced against the drumhead membrane 16.

Figure 2:
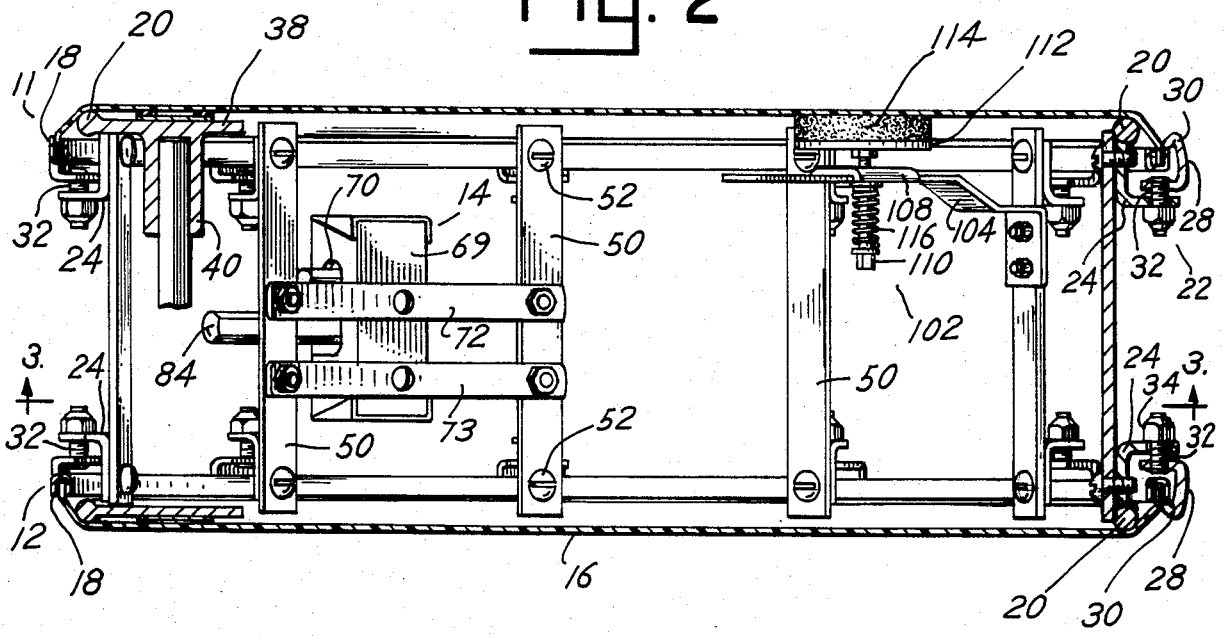
FIG. 2 is a vertical cross sectional view of the snare drum shown in FIG. 1, the cross section being taken on line 2—2 of FIG. 1.
Figure 4:
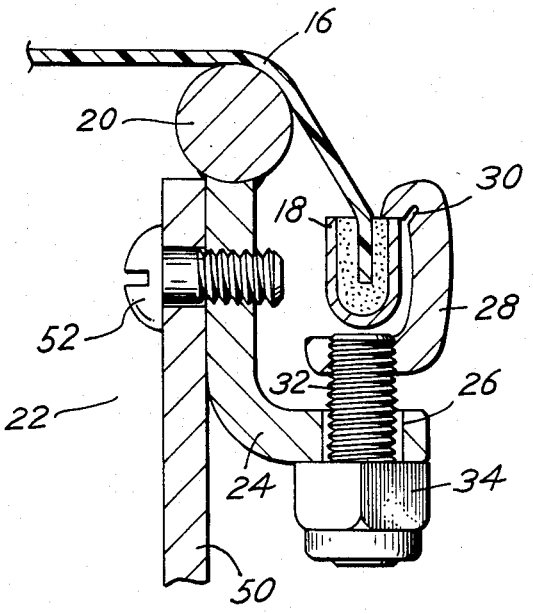
FIG. 4 is an enlarged view of one of the adjustment devices in FIG. 2.
Figure 5:
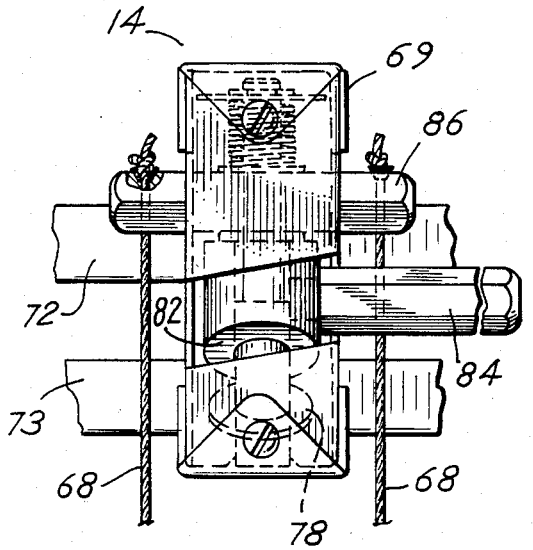
FIG. 5 is an enlarged elevational view of the snare release device shown in FIGS. 1, 2 and 3, with hidden parts being shown by broken lines.
Figure 6:
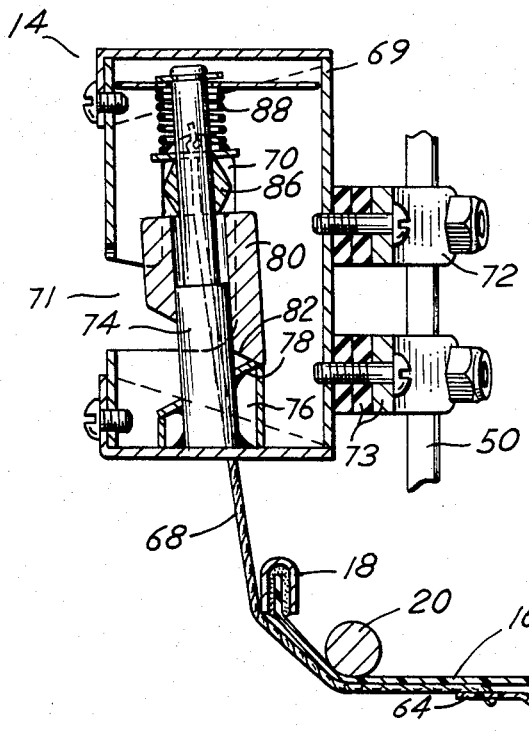
FIG. 6 is a vertical cross sectional view of the snare release device shown in FIG. 3, the cross section being taken on line 6—6 of FIG. 3.
Figure 7:
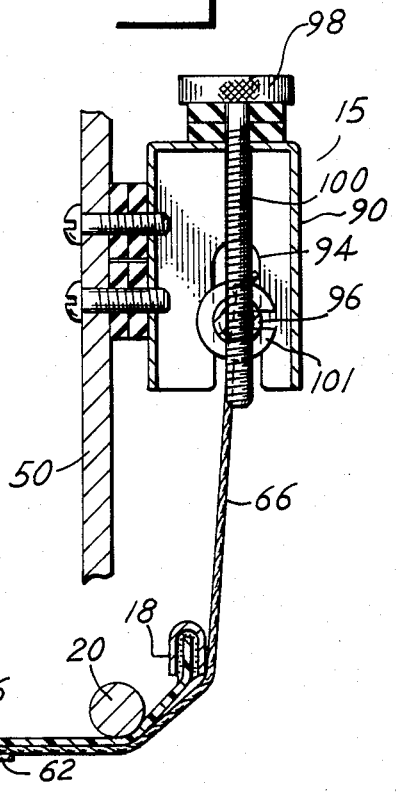
FIG. 7 is a vertical cross sectional view of the snare tension adjustment device shown in FIG. 3, the cross section being taken on line 7—7 of FIG. 3.

A single drumhead as shown in FIG. 8 with its tensioning ring and tension adjustment devices may be used and played without the spacer members 50 and opposing head as has been shown in FIG. 1. Such a single drumhead construction is especially useful in marching band situations where one drummer is required to carry a plurality of drums, as the single headed construction very substantially reduces the drum weight. A holder attachment device 36 consisting of base plate 38 and tubular member 40 is integrally attached to tuning ring 20. A shaft member from any base stand, spinner device or other marching or concert holder may be inserted into tubular member 40 and secured therein by set screws 42 and 44. In the dual headed variety as shown in FIGS. 1 and 2, rigid support members 50 are attached by screws 52 to L-shaped brackets 24 and hold the opposing drumheads in the proper position.

Snare device 13 consists of a plurality of spring-like snares 60 attached at each of their ends to metal plates 62 and 64. String or cord sections 66 and 68 attach plates 62 and 64 to, respectively, snare tension adjustment device 15 and snare release mechanism 14, which are mounted on opposite sides of snare drum 10 to rigid support members 50. Snare release mechanism 14 consists of an outer housing 69 having vertical and horizontal cut-out portions as shown at numerals 70 and 71, and is connected by bars 72 and 73 between two rigid support members 50. A shaft 74 extends from the top to the bottom inside housing 69 and terminates in a base plate 76, which has an upper face 78 generally inclining from the front to the rear. Slidably mounted on shaft 74 is a camming device 80 of which the bottom face 82 generally inclines to the same degree as the incline of base plate 76. An operating handle 84 is attached to camming device 80 and is used to rotate the camming device on shaft 74. When inclined faces 78 and 82 are complementarily matched, camming device 80 is at its lowest position on shaft 74. As operating handle 84 is moved and camming device 80 rotates on shaft 74, faces 78 and 82 no longer match. As the lowest extending portion of face 82 is moved to contact progressively higher portions of face 78, camming device 80 slides higher on shaft 74. Positioned above camming device 80 and also slidable on shaft 74 is a bar 86 to which cord 68 is attached. As camming device 80 is moved farther up shaft 74, so also is bar 86 moved higher on shaft 74, thereby drawing snare device 13 against the lower drumhead 12. A spring 88 on shaft 74 exerts downward pressure to hold faces 78 and 82 against each other.

Snare tension adjustment device 15 consists of an outer housing 90 having slots 92 and 94 through which a horizontal bar 96 passes. Cord 66 is attached to bar 96, and a rotatable knob 98 on the top of housing 90 is attached to a threaded shaft 100 which extends downward through housing 90. Bar 96 has an internally threaded hole to receive threaded shaft 100. Rotation of knob 98, and thereby shaft 100, adjusts the position of bar 96 on shaft 100. Since shaft 100 remains vertically fixed, bar 96 moves up or down in slots 92 and 94 as shaft 100 is rotated. Two snap retainer rings 101 positioned in grooves on opposite ends of bar 96 maintain lateral positioning of the bar. This movement adjusts the tension of snares 60 for any fixed position of release mechanism 14.

For effective operation of the lower head and snare mechanism, at least one adjustable sound control mechanism 102 attached to a support member 50 and in contact with membrane 16 of upper drumhead 11 is provided. Sound control mechanism 102 consists of an attachment arm 104 having a slot 106. A mounting plate 108 is slidably attached to arm 104 and has a centrally located threaded hole through which an adjustment bolt 110 passes. The upper end of adjustment bolt 110 is attached to a base plate 112 on which a felt bumper 114 is fixed. A spring 116 is mounted on adjustment bolt 110 between the head of said bolt and the underside of arm 104. Thus, by adjustment of bolt 110, more or less pressure can be exerted by bumper 114 on the drumhead. The bumper assembly can be moved along arm 104 and slot 106 to points of various distance from the center of the drumhead, thereby creating different drum tones.

In the use and adjustment of a snare drum employing the drumhead tuning device, releasable snare, and adjuster mechanism of the present invention, the drumheads are attached in opposing fashion by rigid spacer members 50 as shown in FIGS. 1 and 2. A shaft from a floor stand, marching holder, spinner rig or the like may be inserted in tubular member 40 of holder attachment device 36 and secured by set screws 42 and 44. The drum is then carried and played in the same fashion as any conventional drum structure. When tuning is required, nuts 34 are adjusted, either to increase or decrease the tension of drumhead 16. Since bracket 28 is engaged with the outer edge of ring 18, as nut 34 is tightened, L-shaped bracket 24, which may slide on threaded member 32, is drawn closer to bracket 28 which does not move. In this way tensioning ring 20 is moved farther past the plane of outer ring 18. This forces the membrane 16 farther above outer ring 18 and thereby increases the tension of the drumhead surface. When nut 34 is loosened, the opposite occurs; that is, brackets 24 and 28 move farther apart, tensioning ring 20 moves closer to the plane of outer ring 18, and the tension of the drumhead decreases. Thus, by tightening or loosening nuts 34, the tension of drumhead 16 may be altered to achieve the desired tune of the drum.

To activate the snare mechanism, operating arm 84 is moved to rotate cam 80 on shaft 74 so that the highest extending portion of face 78 and the lowest extending portion of face 82 are in contact, thereby moving cam 80 and bar 86 upward on shaft 74 and drawing spring-like snares 60 against the surface of drumhead 12. If the tension of snares 60 is insufficient for the desired sound, knob 98 can be rotated to draw bar 96 closer to it, thus increasing the distance between the attachment points of bars 86 and 96 and increasing the tension of snares 60. When the sound created by the snares is not desired, handle 84 is rotated so that inclined faces 78 and 82 complement each other and cam 80 and bar 86 descend on shaft 74, thereby releasing the tension of snares 60. A further modification to the sound of drum 10 can be achieved by adjustment of sound control mechanism 102. Bumper 114 can be moved farther away from or nearer the center of the drumhead membrane 16 by simply sliding it along arm 104. Adjustment of bolt 110 increases or decreases the pressure exerted by bumper 14 on membrane 16, which also will vary the sound output.

Various modifications of the heretofore disclosed embodiment exist. A plurality of adjustable sound control mechanisms such as those shown by numeral 102 may be used. They may be attached to the drum so that they contact the upper surface of the drumhead rather than the lower surface as shown. The tuning ring and its adjustment devices may be used on drums of various sizes and shapes. The drum need not be round but may also be constructed in a square, oblong, triangular or other shape, so long as the tensioning ring takes on the same shape.

It can clearly be seen that this drum structure is exceptionally versatile. The snares can be engaged or disengaged very quickly, even during a performance. With very slight adjustments many sound modifications can be achieved. Storage area requirements are substantially reduced for this type of drum. The single headed embodiment is only about an inch thick. The dual headed assembly may quickly and easily be disassembled, resulting in a storage area requirement equal to that of two single headed drums. Due to the simplicity in design, there is a substantial reduction in weight for this drum structure as compared to previous designs. Hence, marching drummers are able to move more easily and are not subjected to the physical strain as are those drummers carrying conventional drums. Since very little obstruction exists around the periphery of the drum, there is very little muffling or directional interference with the drum sound. Even the dual headed drum assembly more fully achieves omnidirectional sound projection than previous drum designs. Also, the placement of the tuning devices makes them readily accessible. Tuning is not hindered even in the dual headed assembly; therefore, tuning is made easier, thus encouraging the drummer to maintain proper tune of his instrument. Electronic miking can be achieved by simply placing a microphone directly under the drumhead.

Although one embodiment and several modifications have been disclosed in detail herein, various other changes can be made without departing from the scope of the present invention.

I claim:

1. A rimless, shell-less dual headed drum structure with tuning means comprising upper and lower drumheads each having a drumhead membrane with an outer rigid ring attached to the periphery thereof, each of said outer rigid rings being generally U-shaped in cross section for receiving therein the edge and a portion of said membrane to which it is attached inwardly from said edge, and having an exposed lip disposed outwardly from said membrane in the tuned drum, a rigid tensioning ring for each of said drumheads being of slightly less external diameter than the internal diameter of said outer rings, each of said tensioning rings being initially positioned within one of said outer rings and moveable through said outer ring and against said membrane, a plurality of spaced attachment and adjustment devices interconnecting said outer and tensioning rings of each of said drumheads, said devices being attached to said lips of said outer rings and having means for adjustably forcing said tensioning rings above said outer rings and against said membranes, a plurality of rigid spacer members between said drumheads, and a snare device disposed on said drumheads and including a sound control adjustment device in contact with the membrane of one of said heads, a plurality of snares stretched across the other of said drumheads, a snare release mechanism and a snare tension adjustment device connected at opposite ends of said snares, said snare release mechanism and said snare tension adjustment device each being attached to one of said rigid spaced members, said snare release mechanism consisting of a shaft fixed to a fixed cam and having mounted thereon a moveable cam operably connected to said snares, wherein movement of said moveable cam causes said moveable cam to ascend and descend on said shaft to make said snares operational or non-operational.

2. A rimless, shell-less dual headed drum structure as defined in claim 1 in which each of said attachment and adjustment devices comprises a threaded member extending perpendicularly away from said outer ring, an L-shaped member attached to said tensioning ring and having portions perpendicular and parallel to said tensioning ring, said parallel portion having a hole through which said threaded member slidably passes and a nut adjustable on said threaded member for forcing said parallel portion closer to said outer ring when said nut is turned farther onto said threaded member to increase the tension on said membranes.

3. A rimless, shell-less dual headed drum structure as defined in claim 2 in which a bracket in releasably attached to said lip and is connected to said threaded member.

4. A rimless shell-less dual headed drum structure as defined in claim 3 in which a drum carrier and support attachment device is integrally attached to at least one of said tensioning rings.

5. A rimless shell-less dual headed drum structure as defined in claim 4 in which said carrier and support attachment device comprises a base plate with an outwardly extending tube for the reception of a shaft, and at least one set screw in said tube for securing said shaft in position.

6. A rimless shell-less dual headed drum structure as defined in claim 2 in which a drum carrier and support attachment device is integrally attached to at least one of said tensioning rings.

7. A rimless, shell-less dual headed drum structure and tuning device as defined in claim 1 in which said rigid spacer members are secured to said attachment and adjustment devices for retaining said drumheads in spaced relation to each other.

8. A rimless, shell-less dual headed drum structure as defined in claim 1 in which said snare tension adjustment device includes a housing having a rotatable threaded member disposed therein, and a bar attached to said snares threaded on said member.

9. In a dual headed drum structure: a snare device assembly comprising a plurality of snares stretched across one of said drumheads, a snare release mechanism including a housing, a vertical shaft and a cam fixed to said housing and a moveable cam on said shaft, a bar connected to said snares slidably mounted on said shaft above said moveable cam and a handle attached to said moveable cam for rotating said moveable cam on said shaft, and a snare tension adjustment device including a housing with slots in the sides thereof, a rotatable threaded member vertically disposed therein, and a bar connected to said snares threaded on said member and extending outwardly into said slots, said release mechanism and said adjustment device being connected at opposite ends of said snares.

10. In a dual headed drum structure: a snare device assembly as defined in claim 9 in which a sound control adjustment device is in contact with the membrane of the other of said drumheads.

11. A rimless, shell-less dual headed drum structure with tuning means comprising upper and lower drumheads each having a drumhead membrane with an outer rigid ring attached to the periphery thereof, each of said outer rigid rings being generally U-shaped in cross section for receiving therein the edge of a portion of said membrane to which it is attached inwardly from said edge, and having an exposed lip disposed outwardly from said membrane in the tuned drum, a rigid tensioning ring for each of said drumheads being of slightly less external diameter than the internal diameter of said outer rings, each of said tensioning rings being initially positioned within one of said outer rings and moveable through said outer ring and against said membrane, a plurality of spaced attachment and adjustment devices interconnecting said outer and tensioning rings of each of said drumheads, said devices being attached to said lips of said outer rings and having means for adjustably forcing said tensioning rings above said outer rings and against said membranes, a plurality of rigid spacer members between said drumheads, and a snare device disposed on said drumheads and including a sound control adjustment device in contact with the membrane of one of said heads, a plurality of snares stretched across the other of said drumheads, a snare release mechanism and a snare tension adjustment device connected at opposite ends of said snares, said snare release mechanism and said snare tension adjustment device each being attached to one of said rigid spacer members, said sound control adjustment device including an arm attached to said rigid spacers, a slidably mounted plate having a threaded hole mounted on said arm, a bolt threaded into said hole, and a bumper for contacting said membrane attached to said bolt.

12. A rimless, shell-less dual headed drum structure as defined in claim 11 in which each of said attachment and adjustment devices comprises a threaded member extending perpendicularly away from said outer ring, and L-shaped member attached to said tensioning ring and having portions perpendicular and parallel to said tensioning ring, said parallel portion having a hole through which said threaded member slidably passes, and a nut adjustable on said threaded member for forcing said parallel portion closer to said outer ring when said nut is turned farther onto said threaded member to increase the tension on said membranes.

13. A rimless, shell-less dual headed drum structure as defined in claim 12 in which a bracket is releasably attached to said lip and is connected to said threaded member.

14. A rimless, shell-less dual headed drum structure as defined in claim 13 in which a drum carrier and support attachment device is integrally attached to at least one of said tensioning rings.

15. A rimless, shell-less dual headed drum structure as defined in claim 14 in which said carrier and support attachment device comprises a base plate with an outwardly extending tube for the reception of a shaft, and at least one set screw in said tube for securing said shaft in position.

16. A rimless, shell-less dual headed drum structure as defined in claim 12 in which a drum carrier and support attachment device is integrally attached to at least one of said tensioning rings.

17. A rimless, shell-less dual headed drum structure and tuning device as defined in claim 11 in which said rigid spacer members are secured to said attachment and adjustment devices for retaining said drumheads in in spaced relation to each other.

18. A rimless, shell-less dual headed drum structure as defined in claim 11 in which said snare tension adjustment device includes a housing having a rotatable threaded member disposed therein, and a bar attached to said snares threaded on said member.

* * * * *